US007441327B2

(12) United States Patent
Furuya et al.

(10) Patent No.: US 7,441,327 B2
(45) Date of Patent: Oct. 28, 2008

(54) TERMINAL INSERTING APPARATUS

(75) Inventors: Hiroshi Furuya, Shizuoka (JP); Kazuhiko Sugimura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 187 days.

(21) Appl. No.: 11/230,665

(22) Filed: Sep. 21, 2005

(65) Prior Publication Data

US 2006/0063430 A1 Mar. 23, 2006

(30) Foreign Application Priority Data

Sep. 22, 2004 (JP) ..... 2004-275109

(51) Int. Cl.
*H01R 43/20* (2006.01)

(52) U.S. Cl. ..... 29/748; 29/747; 29/755; 29/757; 439/595; 439/596; 439/603

(58) Field of Classification Search ..... 29/748, 29/749, 757, 747, 755; 439/595, 596, 603, 439/590

See application file for complete search history.

(56) References Cited

U.S. PATENT DOCUMENTS 6,141,867 A * 11/2000 Fukada et al. ..... 29/747
6,212,766 B1 * 4/2001 Ohsumi et al. ..... 29/755
2002/0174537 A1 * 11/2002 Chujo et al. ..... 29/747

FOREIGN PATENT DOCUMENTS

JP 60130078 A * 7/1985

* cited by examiner

*Primary Examiner*—Peter DungBa Vo
*Assistant Examiner*—Livius R Cazan
(74) *Attorney, Agent, or Firm*—Kratz, Quintos & Hanson, LLP

(57) ABSTRACT

A terminal insertion apparatus includes a wire-holding unit, a housing-holding unit, and an terminal-inserting unit. The wire-holding unit holds electric wires connected to terminal fittings. The housing-holding unit holds a connector housing. The terminal-inserting unit inserts the terminal fittings connected to the electric wires held by the wire-holding unit into the connector housing. The terminal-inserting unit keeps holding the electric wire connected to the lastly inserted terminal fitting and moves the electric wire to the wire-holding unit. Then, the wire-holding unit holds the electric wire.

2 Claims, 14 Drawing Sheets

TERMINAL INSERTING APPARATUS

BACKGROUND OF THE INVENTION

The priority application claims priority of Japanese Patent Application No. 2004-275109, which is hereby incorporated by reference.

FIELD OF THE INVENTION

This invention relates to a terminal inserting apparatus for inserting terminal fittings connected to electric wires into terminal-receiving holes of a connector housing.

A wire harness arranged in a vehicle as a moving member is assembled by sequentially inserting terminal fittings connected to electric wires into the terminal-receiving holes of the connector housing. For inserting the terminal fittings into the terminal-receiving holes of the connector housing, conventionally, various terminal inserting apparatuses are used.

The terminal inserting apparatus includes an apparatus body, a housing retainer for retaining a connector housing, a wire holder for holding an electric wire, and an inserting head for inserting a terminal. The main body is set on a floor of a factory or the like. The housing retainer is mounted on the apparatus body, and the connector housings are attached to the housing retainer. The wire holder holds the electric wires connected to terminal fittings. The inserting head removes the electric wires from the wire holder, and inserts the terminal fittings connected to the electric wires into the terminal-receiving holes of the connector housing.

In the terminal inserting apparatus, after all the terminal fittings are inserted into the terminal-receiving holes, a projecting pin or the like mounted on the housing retainer removes the connector housing from the housing retainer. Then, an operator puts the electric wires attached to the connector housing in the wire holder for holding the electric wires. In the terminal inserting apparatus, terminal fittings are inserted into the terminal-receiving holes of the connector housing in this way.

In the conventional terminal inserting apparatus described above, an operator attaches the connector housing removed from the housing retainer to the wire holder by hand. Therefore, working efficiency tends to decrease. Further, since the operator attaches the connector housing to the wire holder by hand, attached positions in the wire holder are varied, and a wrong connector housing may be used in the following process.

Accordingly, an object of this invention is to provide a terminal inserting apparatus that prevents reduction of working efficiency and that allows a connector housing having terminal fittings to be attached to a wire holder at a correct position thereof.

SUMMARY OF THE INVENTION

In order to attain the object, according to the present invention, there is provided a terminal inserting apparatus for inserting terminal fittings connected to electric wires into terminal-receiving holes of a connector housing, said terminal inserting apparatus including:

an electric wire holder for holding electric wires connected to the terminal fittings;

a terminal-inserting unit for removing the electric wires from the electric wire holders and inserting the terminal fittings connected to the electric wires into the terminal-receiving holes of the connector housing, wherein after all the terminal fittings to be inserted being inserted into the terminal-receiving holes, the terminal-inserting unit keeps holding the electric wire of the lastly inserted terminal fitting, moves the electric wires with the connector housing to the electric wire holder, and makes the electric wire holder hold the electric wires.

Preferably, the terminal inserting apparatus further includes:

a housing retainer for retaining the connector housing; and an elevating unit for vertically supporting the housing retainer;

wherein when said terminal insertion unit keeps holding the electric wire connected to the lastly inserted terminal fitting of the connector housing retained by the housing retainer, said elevating unit moves the housing retainer down for removing the connector housing from the housing retainer.

Preferably, the terminal inserting apparatus further includes including a connector fixing unit for switching the housing retainer between two positions of locking and unlocking the connector housing, said connector fixing unit being supported vertically with the housing retainer by the elevating unit, wherein said connector fixing unit holds the housing retainer in the position of locking the connector housing when the terminal-inserting unit inserts the terminal fittings into the terminal-receiving holes, and switches the housing retainer into the position of unlocking the connector housing after the terminal fittings are inserted into the receiving holes.

The above and other objects, features, and advantages of the present invention will be better understood when taken in connection with the accompanying drawings and description.

DESCRIPTION OF THE PREFERRED EMBODIMENTS

Figure 1:
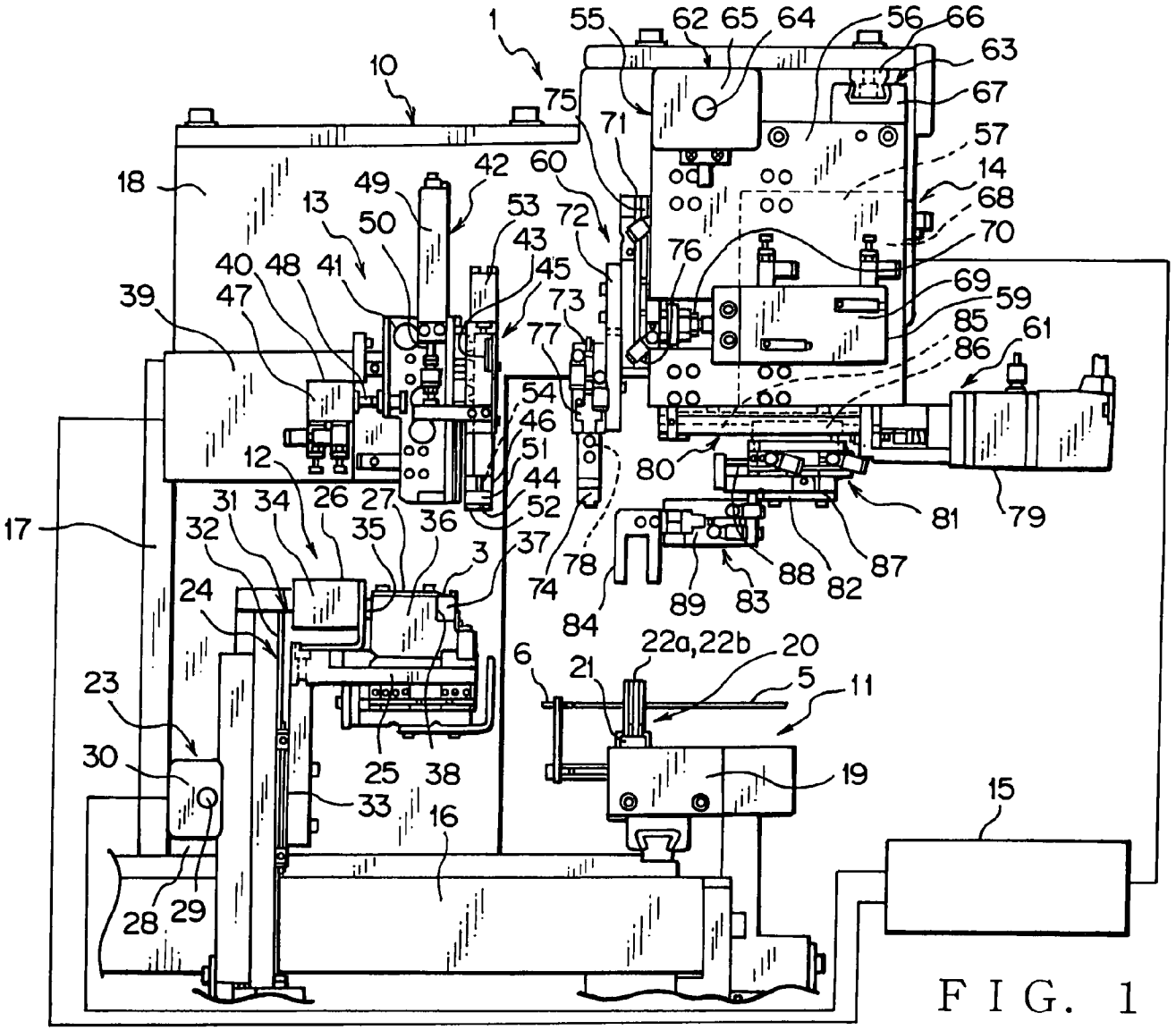
FIG. 1 is a side view showing a configuration of a terminal inserting apparatus according to a first embodiment of the present invention.

A terminal inserting apparatus 1 according to a first embodiment of the present invention will be explained with reference to FIGS. 1 to 16. As shown in FIG. 1, the terminal inserting apparatus 1 is, for example, an apparatus for inserting terminal fittings 6 connected to electric wires 5 into receiving holes 4 of a connector housing 3 respectively.

The connector housing 3 is made of insulating synthetic resin and in a box shape. The connector housing 3 has a plurality of terminal-receiving holes 4. The terminal-receiving holes 4 extend straight and penetrate the connector housing 3. The terminal-receiving holes 4 receive the terminal fittings 6 connected to the electric wires 5.

The terminal fittings 6 are connected to the electric wires 5. Each electric wire 5 is a so-called coated electric wire having a conductive core wire and an insulating coat.

A connector 2 includes the connector housing 3 having terminal fittings 6 connected to the electric wires 5 and received in terminal-receiving holes 4 thereof. A wire harness for being arranged in a vehicle is formed by the connector 2 connecting to a mating connector or the like. Either the receiving holes 4 or the terminal fittings 6 include locking arms for locking on the other. The connector housing 3 and each of the terminal fittings 6 are fixed to each other by the locking arm.

As shown in FIG. 1, the terminal inserting apparatus 1 includes an apparatus body 10, a wire-holding unit 11, a housing-holding unit 12, a guiding unit 13, a terminal-inserting unit 14, and a controller 15.

The apparatus body 10 is set on a floor of a factory or the like. The apparatus body 10 includes a table 16 of which top wall is flat in a horizontal direction, a vertical column 17, and a vertical board 18. The vertical column 17 and the vertical board 18 are arranged vertically upward from a top wall of the table 16

Figure 3:
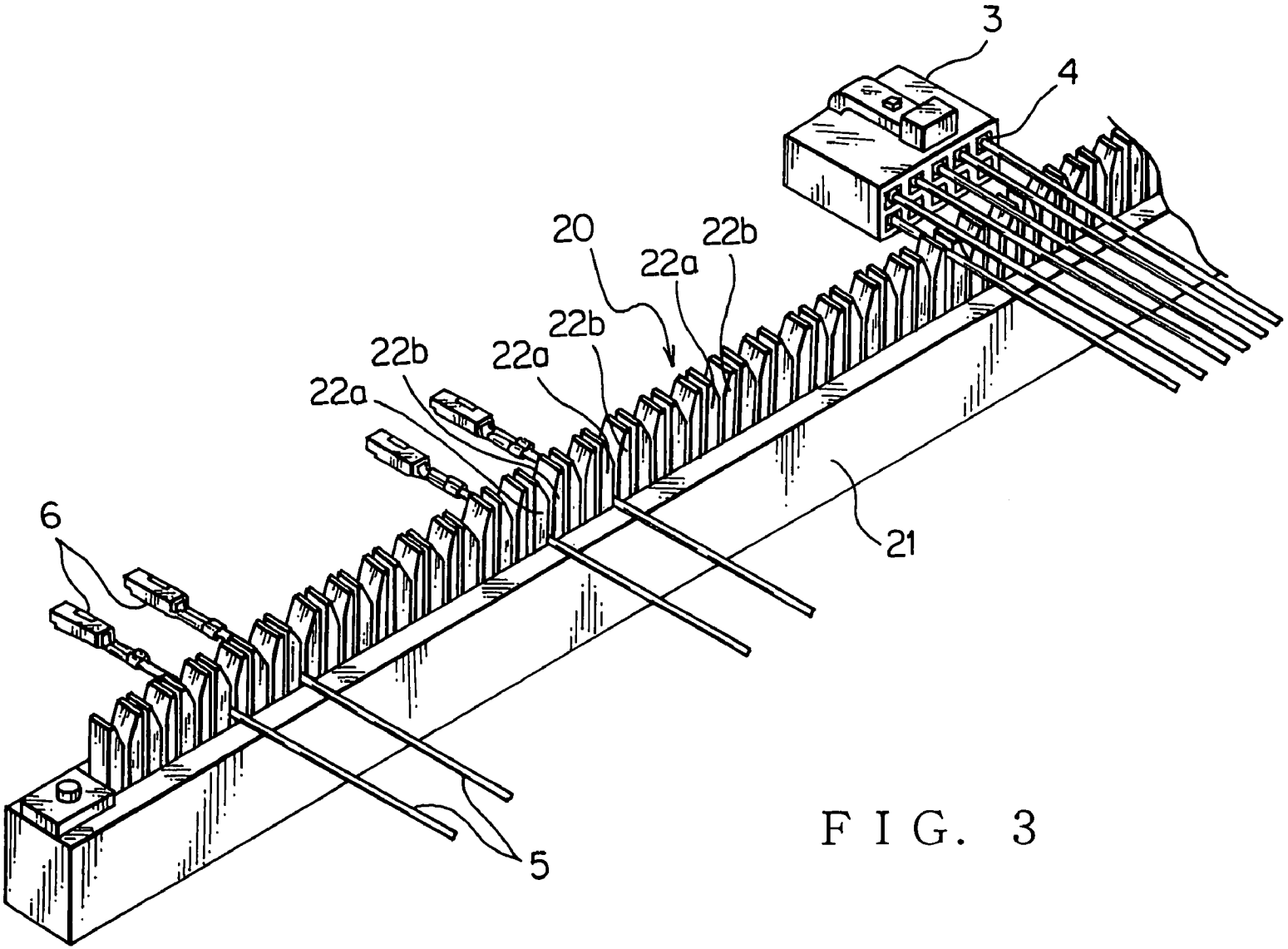
FIG. 3 is a perspective view showing a wire holder and the like of the terminal inserting apparatus shown in FIG. 1.

As shown in FIGS. 1 and 3, the wire-holding unit 11 includes a unit body 19 and a wire holder 20 detachably attached to the unit body 19. The unit body 19 is attached to the table 16 of the apparatus body 10. The unit body 19 is formed in a bar (column) shape of which longitudinal direction is parallel to the horizontal direction. The longitudinal direction of the unit body 19 is parallel to a front to back direction of FIG. 1.

As shown in FIG. 3, the wire holder 20 includes a holder body 21 and a plurality of picking members 22*a*, 22*b* vertically arranged from the holder body 21. The holder body 21 is attached to the unit body 19 in a manner that the holder body 21 in a longitudinal direction is parallel to the unit body 19 in a longitudinal direction.

The clipping members 22*a*, 22*b* are supported movably toward or away from each other by the holder body 21. The clipping members 22*a*, 22*b* are pushed toward each other. The clipping members 22*a*, 22*b* are arranged close together in the longitudinal direction of the holder body 21. As shown in FIG. 3, a plurality of pairs of the clipping members 22*a*, 22*b* are arranged in the longitudinal direction of the holder body 21. The electric wire 5 is clipped between the pair of clipping members 22*a*, 22*b*.

Before the electric wire 5 is inserted into the terminal-receiving hole 4 of the connector housing 3, the wire-holding unit 11 holds the electric wire 5 connected to the terminal fitting 6 by clipping between the clipping members 22*a*, 22*b*. After the electric wire 5 is inserted into the terminal-receiving hole 4 of the connector housing 3, the wire-holding unit 11 also holds the electric wire 5 connected to the terminal fitting 6 by clipping between the clipping members 22*a*, 22*b*, namely, holds the connector housing 3.

As shown in FIG. 1, the housing-holding unit 12 includes a horizontally moving unit 23, an elevating unit 24, a supporting table 25, a connector-fixing cylinder 26 as a connector fixing unit, and a housing retainer 27.

The horizontally moving unit 23 includes a not-shown motor and a ball screw 28. The motor is mounted on the apparatus body 10. The ball screw 28 includes a screw shaft 29 and a nut 30. The screw shaft 29 is supported horizontally and rotatably by the apparatus body 10. The screw shaft 29 is rotated about an axis thereof by the motor.

Incidentally, the axial direction of the screw shaft 29 is parallel to the front to back direction of FIG. 1. The nut 30 is screwed on the screw shaft 29. The elevating unit 24, namely, the housing retainer 27 is linked to the nut 30. The horizontally moving unit 23 moves the nut 30, namely, the housing retainer 27 along the axial direction of the screw shaft 29 by the motor.

The elevating unit 24 includes a not-shown motor and a ball screw 31. The motor is linked to the nut 30. The ball screw 31 includes a screw shaft 32 and a nut 33. The screw shaft 32 is supported vertically and rotatably by the nut 30. The screw shaft 32 is rotated about an axis thereof by the motor. The nut 33 is screwed on the screw shaft 32. The supporting table 25, namely, the housing retainer 27 is linked to the nut 33. The elevating unit 24 moves the nut 33, namely, the housing retainer 27 along the axial direction of the screw shaft 32 by the motor. Thus, the elevating unit 24 supports the housing retainer 27 elevatably.

The supporting table 25 is attached to the nut 33 of the elevating unit 24. The supporting table 25 extends from the nut 33 toward the wire-holding unit 11 horizontally.

The connector-fixing cylinder 26 includes a cylinder body 34 attached to the supporting table 25, and an extendable rod 35 mounted on the cylinder body 34. The cylinder body 34 is mounted on the supporting table 25 in a manner that the extendable rod 35 extends horizontally toward the wire-holding unit 11. When the rod 35 extends, the rod 35 pushes a later described sliding member 37 of the housing retainer 27 against force of a coil spring. When the rod 35 extends, the connector-fixing cylinder 26 holds the housing retainer 27 in a later-described position of locking the connector housing.

When the rod 35 contracts, the rod 35 becomes not to push the sliding member 37 of the housing retainer 27. When the rod 35 contracts, the connector-fixing cylinder 26 holds the housing retainer 27 in a later-described position of unlocking a connector housing. Thus, the connector-fixing cylinder 26 is elevatably supported by the elevating unit 24 with the housing retainer 27, and switches the housing retainer 27 between two positions of locking and unlocking the connector housing.

Figure 2:
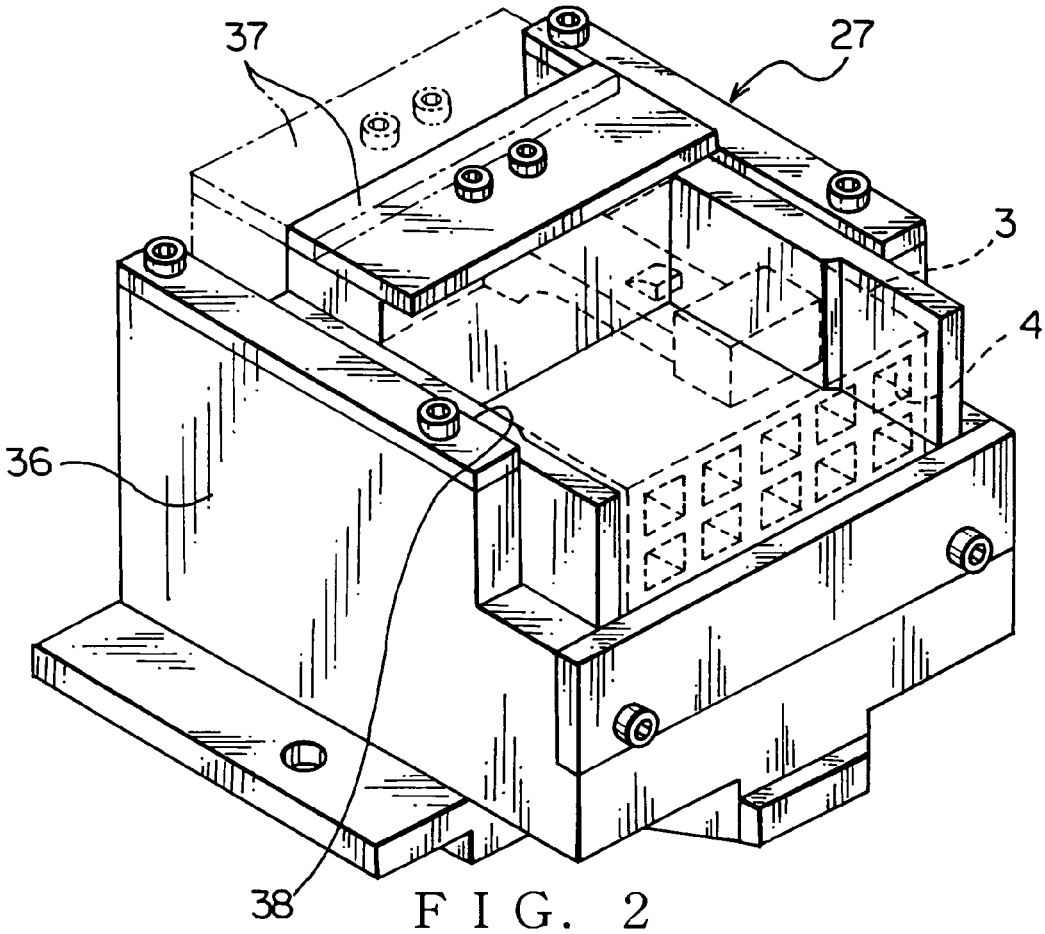
FIG. 2 is a perspective view showing a housing retainer of the terminal inserting apparatus shown in FIG. 1.
Figure 6:
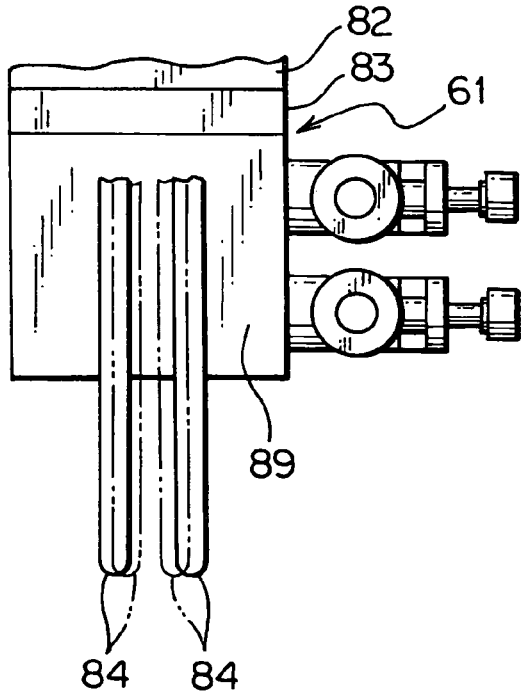
FIG. 6 is a front view showing a wire chucking unit and the like of the terminal inserting apparatus shown in FIG. 1.

The housing retainer 27 is mounted on the supporting table 25. The housing retainer 27 is arranged closer to the wire-holding unit 11 than the connector-fixing cylinder 26. As shown in FIG. 2, the housing retainer 27 includes a substantially box-shaped retainer body 36, the sliding member 37, and a not-shown coil spring. An opening 38 is formed corresponding to an outer shape of the sliding member 37 on the retainer body 36. The opening 38 is formed across from a top wall of the retainer body 36 to an end wall close to the wire-holding unit 11.

The sliding member 37 is mounted inside the opening 38. The sliding member 37 is supported on the retainer body 36 slidably toward the wire-holding unit 11. As shown by a solid line in FIG. 2, when the sliding member 37 moves toward the wire-holding unit 11, the connector housing 3 is clipped between the retainer body 36 and the sliding member 37. The connector housing 3 is guided horizontally by sidewalls of the retainer body 36, and regulated vertically by a top wall of the sliding member 37 for preventing the connector housing 3 from falling out of the retainer body 36.

As shown by alternate long and two short dashes line in FIG. 2, when the sliding member 37 moves backward from the wire-holding unit 11, the sliding member 37 allows the connector housing 3 to come out from the opening thereof and to remove from the retainer body 36. Hereafter, the state shown by the solid line in FIG. 2 is referred to as a position of locking the connector housing, and the state shown by the long and two short dashes line in FIG. 2 is referred to as the position of unlocking the connector housing. The coil spring pushes the sliding member 37 backward from the wire-holding unit 11.

Thus, the housing retainer 27 is switched between the locking position in which the connector housing 3 is prevented from coming out from the housing retainer 27, and the unlocking position in which the connector housing 3 is allowed to be removed from the housing retainer 37.

In the housing-holding unit 12, before the terminal fittings 6 are inserted into the terminal-receiving holes 4 of the connector housing 3, the elevating unit 24 elevates the supporting table 25, namely, the housing retainer 27, the connector-fixing cylinder 26 holds the housing retainer 27 in the position of locking the connector housing, and the connector housing 3 is fixed on the housing retainer 27.

In the housing-holding unit 12, after all the terminal fittings 6 to be inserted are inserted into the terminal-receiving holes 4 of the connector housing 3, in other word, after the last terminal fitting is inserted, the connector-fixing cylinder 26 switches the housing retainer 27 into the unlocking position. Then, while a wire-chucking unit 61 chucks the electric wire 5 connected to the lastly inserted terminal fitting 6, the elevating unit 24 moves the housing retainer 27 down. The housing-holding unit 12 removes the connector housing 3 from the housing retainer 27.

As shown in FIG. 1, the guiding unit 13 includes a main board 39, a cross feed cylinder 40, a supporting board 41, an elevating cylinder 42, an elevating board 43, a fixed guiding board 44, a guide switching part 45, and a movable guiding board 46. The main board 39 is attached to a top end of the vertical column 17 on a side opposite to the table 16. The main board 39 extends horizontally from the vertical column 17 toward the wire-holding unit 11.

The cross feed cylinder 40 includes a cylinder body 47 and an extendable rod 48 mounted on the cylinder body 47. The cylinder body 47 is mounted on the main board 39 in a manner that the rod 48 extends horizontally toward the wire-holding unit 11. In the cross feed cylinder 40, extension of the rod 48 removes the supporting board 41, namely, guiding boards 44, 46 from the housing retainer 27 and moves them toward the wire-holding unit 11. Contraction of the rod 48 moves the supporting board 41, namely, guiding boards 44, 46 toward the housing retainer 27.

The supporting board 41 is mounted on the rod 48 of the cross feed cylinder 40. The elevating cylinder 42 includes a cylinder body 49 and an extendable rod 50 mounted on the cylinder body 49. The cylinder body 49 is attached to the supporting board 41 in a manner that the rod 50 extends vertically, and extension of the rod 50 moves a top thereof toward the housing-holding unit 12.

Extension of the rod 50 moves the elevating board 43, namely, guiding boards 44, 46 toward the housing retainer 27. Contraction of the rod 50 of the elevating cylinder 42 moves the elevating board 43, namely, guiding boards 44, 46 away from the housing retainer 27. Thus, the elevating cylinder 42 supports elevatably the elevating board 43, namely, the guiding boards 44, 46.

Figure 4:
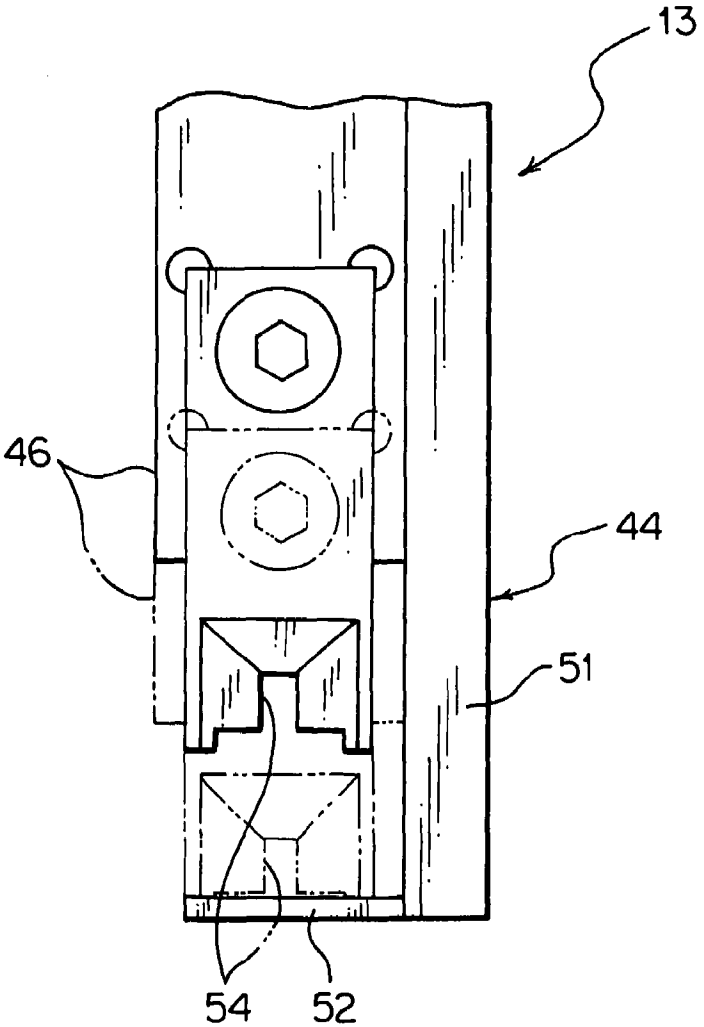
FIG. 4 is a front view showing fixed and movable guiding boards of a guiding unit and the like of the terminal inserting apparatus shown in FIG. 1.
Figure 7:
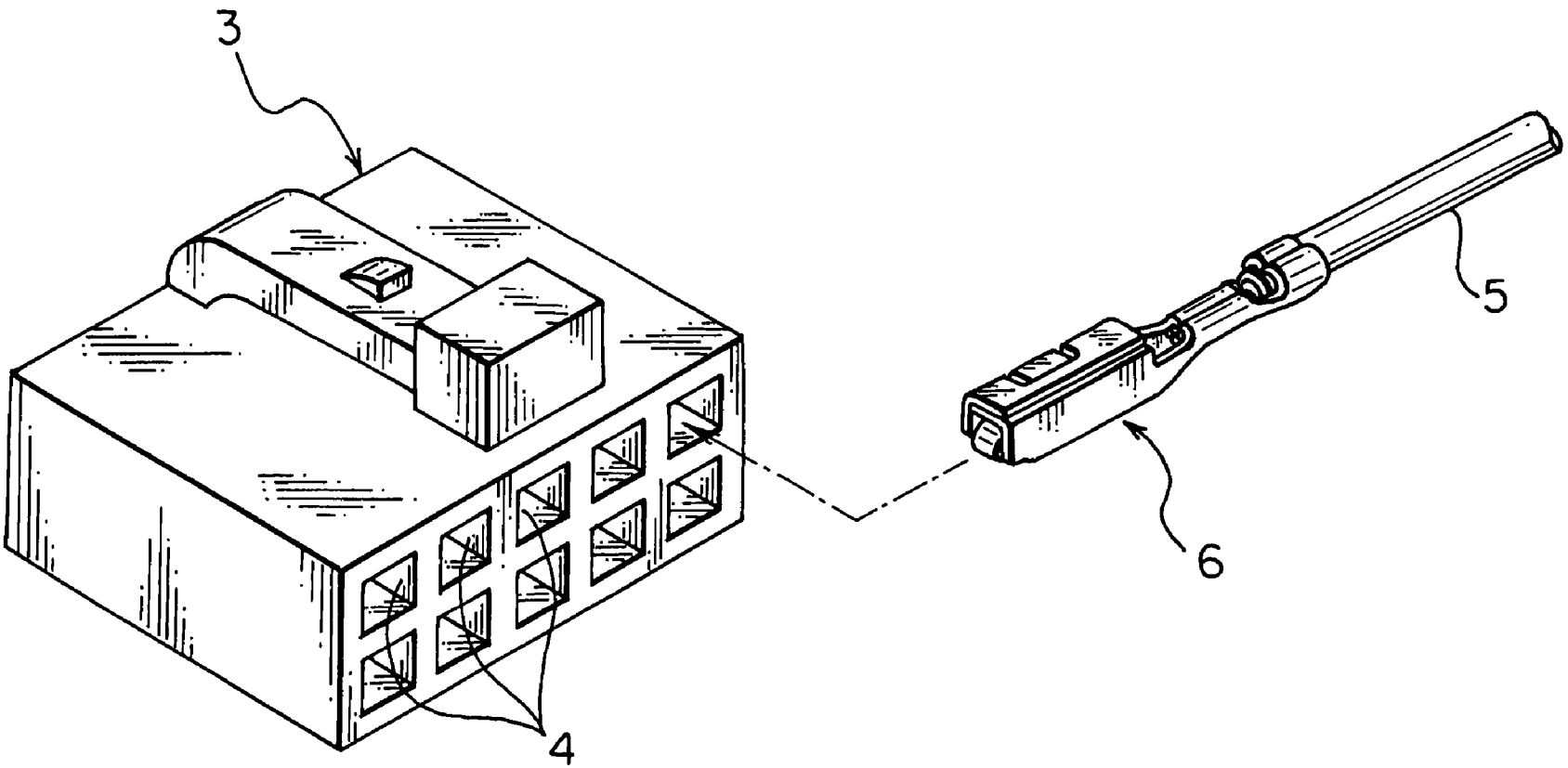
FIG. 7 is a perspective view showing a connector housing into which terminal fittings are inserted and the like in the terminal inserting apparatus shown in FIG. 1.

The elevating board 43 is mounted on the rod 50 of the elevating cylinder 42. The fixed guiding board 44 is attached to the elevating board 43. As shown in FIG. 4, the fixed guiding board 44 integrally includes a vertical part 51 extending vertically and a horizontal part 52 extending horizontally from a bottom end of the vertical part 51.

The guide switching part 45 includes a switching cylinder 53 and an extendable not-shown rod mounted on the switching cylinder 53. The switching cylinder 53 is attached to the elevating board 43 in a manner that the not-shown rod extends vertically and extension of the not-shown rod moves a top thereof toward the housing-holding unit 12. The extension of the not-shown rod of the guide switching part 45 moves the movable guiding board 46 toward the housing retainer 27. Contraction of the not-shown rod moves the movable guiding board 46 away from the housing retainer 27. Thus, the movable guiding board 46 is movable in between positions shown by a solid line and an alternate long and two short dashes line in FIG. 4.

The movable guiding board 46 is mounted on the not-shown rod of the guide switching part 45. The movable guiding board 46 is supported by the elevating board 43 and movable in the vertical direction. The movable guiding board 46 is formed in a band-plate shape and longitudinally extends in the vertical direction. A guiding opening 54 is formed at a bottom end of the movable guiding board 46. A gap of the guiding opening 54 is formed narrower in a horizontal direction (from right to left in FIG. 1) toward the housing retainer 27, and as narrow as the opening of the terminal-receiving hole 4 at an end facing the housing retainer 27 thereof.

For guiding the terminal fitting 6 into the terminal receiving hole 4 of the connector housing 3, firstly the housing retainer 27 of the housing-holding unit 12 is positioned under the guiding unit 13. Then, the not-shown rod of the switching cylinder 53 contracts, the rod 48 of the cross feed cylinder 40 extends, and the rod 50 of the elevating cylinder 42 extends. Thereby, the guiding boards 44, 46 horizontally overlap with the opening of the terminal-receiving hole 4 of the connector housing 3 retained by the housing retainer 27. Then, in the guiding unit 13, the not-shown rod of the switching cylinder 53 extends to make the horizontal part 52 of the fixed guiding board 44 contact the bottom end of the movable guiding board 46 (shown by the alternative long and two short dashes line in FIG. 4).

Then, a bottom of the guiding opening 54 is closed with the horizontal part 52 of the fixed guiding board 44, and a surface of the guiding opening 54 is substantially equal to that of the opening of the terminal-receiving hole 4. Then, the rod 48 of the cross feed cylinder 40 contracts to make the guiding boards 44, 46 contact the connector housing 3 retained by the housing retainer 27. Resultingly, the guiding opening 54 communicates with the terminal-receiving holes 4 into which the terminal fitting 6 is to be inserted. Thus, the guiding unit 13 guides the terminal fitting 6 connected to the electric wires 5 to the terminal-receiving holes 4 of the connector housing 3 through the guiding opening 54.

Figure 9:
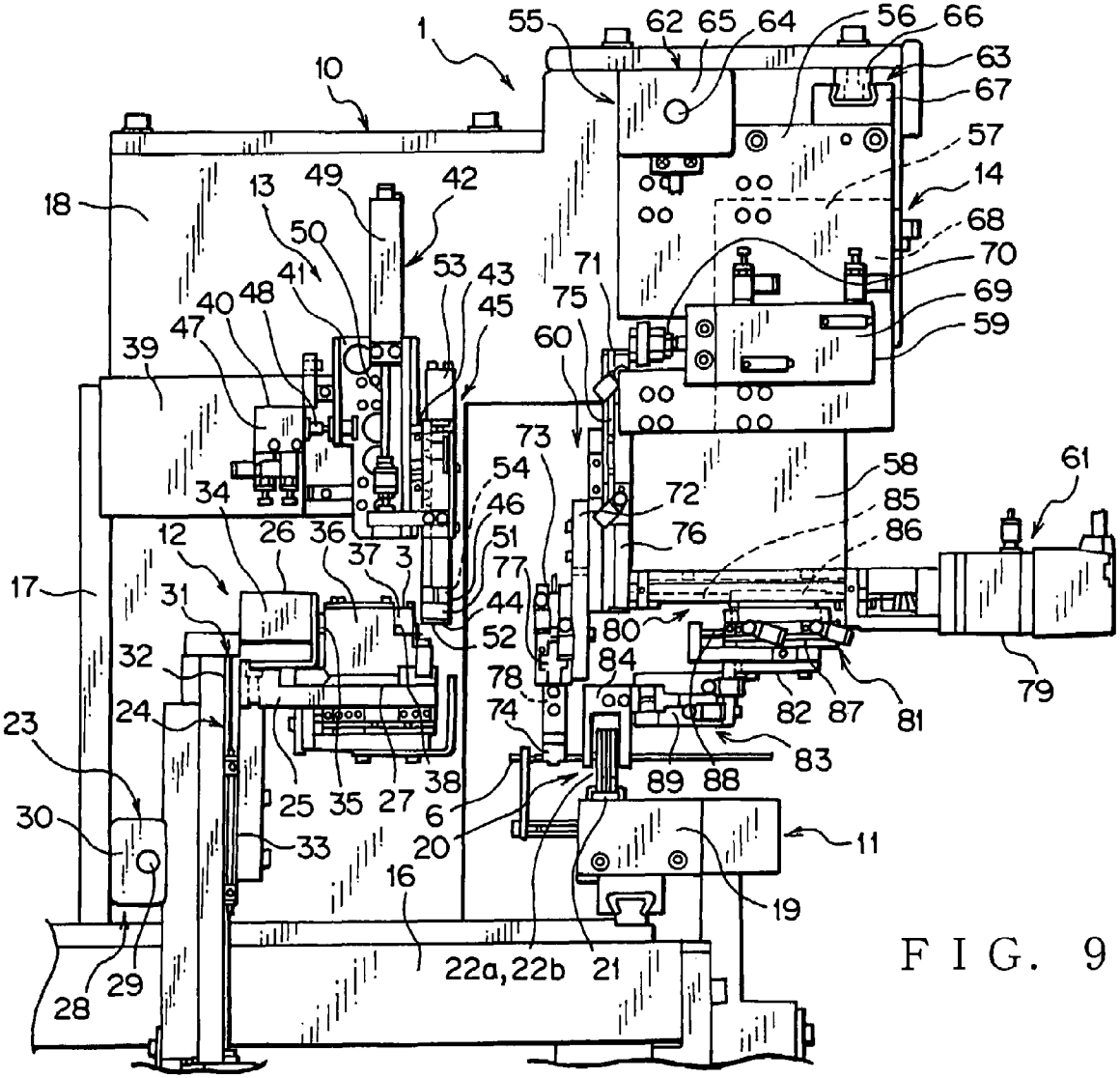
FIG. 9 is a side view showing a state that the guiding boards is moved down from a position shown in FIG. 8, and the chucking units chuck the electric wire and the terminal fitting held by the wire holder.

As shown in FIGS. 1 and 9, the terminal-inserting unit 14 includes a horizontally moving unit 55, a horizontally moving board 56, an elevating cylinder 57, an elevating board 58, an inserting cylinder 59, a front chucking unit 60, and a wire-chucking unit 61.

The horizontally moving unit 55 includes a not-shown motor, a ball screw 62, and a linear guide 63. The motor is mounted on the apparatus body 10. The ball screw 62 includes a screw shaft 64 and a nut 65. The screw shaft 64 is supported horizontally and rotatably by the apparatus body 10 at a top end of the vertical board 18. The screw shaft 64 is rotated about an axis thereof by the motor. Incidentally, the axial direction of the screw shaft 64 is parallel to a direction from front to back or from back to front of FIG. 1. The nut 65 is screwed on the screw shaft 64. The horizontally moving board 56 is attached to the nut 65, namely, the front chucking unit 60 and the wire-chucking unit 61 are linked to the nut 65.

The linear guide 63 includes a rail 66 and a slider 67. The rail 66 is attached to, for example, the vertical board 18 in a manner that the rail longitudinally extends in a direction parallel to the screw shaft 64. The slider 67 is attached to the rail 66 slidably in a longitudinal direction of the rail 66. The horizontally moving board 56 is mounted on the slider 67, namely, the front chucking unit 60 and the wire-chucking unit 61 are linked to the temperature controller 67.

The horizontally moving unit 55 moves the nut 65 and the horizontally moving board 56, namely, the front chucking unit 60 and the wire-chucking unit 61 along the longitudinal direction of the screw shaft 64 by driving force of the motor.

The horizontally moving board 56 is attached to both the nut 65 and the slider 67. The horizontally moving board 56 extends downward from the nut 65 and the slider 67.

The elevating cylinder 57 includes a cylinder body 68 attached to the horizontally moving board 56 and a not-shown extendable rod extends from the cylinder body 68. The elevating cylinder 57 moves the elevating board 58 up and down by expansion and contraction of the not-shown rod.

The elevating board 58 is elevatably supported by the horizontally moving board 56 and vertically movable toward the housing-holding unit 12 along the horizontally moving board 56.

The inserting cylinder 59 includes a cylinder body 69 mounted on the horizontally moving board 56, and an extendable rod 70 extending from the cylinder body 69. The elevating board 58 is attached to the rod 70. In the inserting cylinder 59, extension of the rod 70 moves the elevating board 58, namely, the front chucking unit 60, and the wire-chucking unit 61 toward the housing-holding unit 12. In the inserting cylinder 59, contraction of the rod 70 moves the elevating board 58, namely, the front chucking unit 60 and the wire-chucking unit 61 away from the housing-holding unit 12. Thus, the inserting cylinder 59 makes the elevating board 58, namely, the front chucking unit 60 and the wire-chucking unit 61 contact and remove from the housing-holding unit 12.

The front chucking unit 60 includes an elevating cylinder 71, a supporting board 72, a chucking cylinder 73, and a pair of front chucks 74.

As shown in FIG. 9, the elevating cylinder 71 includes a cylinder body 75, and an extendable rod 76 extending from the cylinder body 75. The cylinder body 75 is attached to the elevating board 58 at an end wall near the housing-holding unit 12. The rod 76 extends downward from the cylinder body 75.

Figure 5:
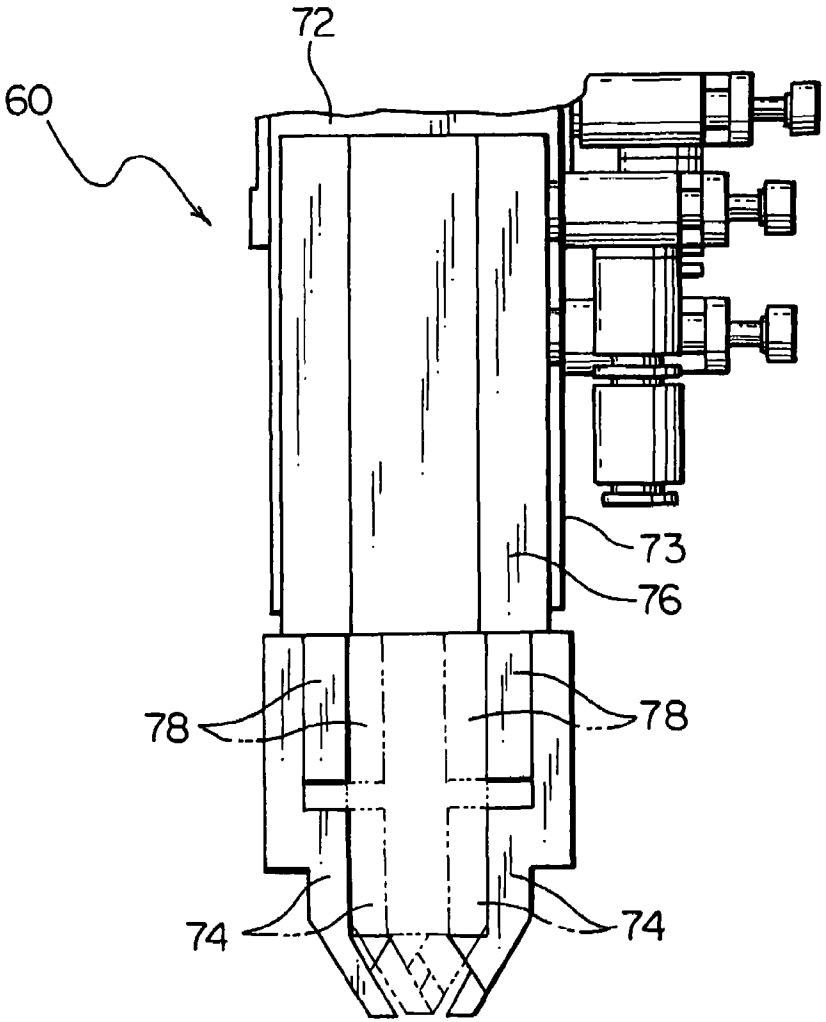
FIG. 5 is a front view showing a front chucking unit and the like of the terminal inserting apparatus shown in FIG. 1.

A front wall of the supporting board 72 is arranged vertically, and attached to the rod 76 of the elevating cylinder 71. As shown in FIG. 5, the chucking cylinder 73 includes a cylinder body 77 attached to the supporting board 72, and a pair of contacting rods 78 projecting from the cylinder body 77. The contacting rods 78 project downward from the cylinder body 77 and are arranged from front to back of FIG. 1 separately.

The pair of contacting rods 78 moves between positions shown by a solid line and an alternative long and short dashes line in FIG. 5 to move toward and away from each other. The front chucks 74 are respectively attached to the contacting rods 78. The pair of front chucks 74 moves toward each other and catches the electric wire 5 therebetween.

As shown in FIG. 1, the wire-chucking unit 61 includes an inserting motor 79, a ball screw 80, a pull-testing cylinder 81, a chuck-supporting board 82, a chucking cylinder 83, and a pair of wire-chucks 84.

The inserting motor 79 is mounted on a bottom end of the elevating board 58. The ball screw 80 includes a screw shaft 85 and a nut 86. The screw shaft 85 extends horizontally and in a right-to-left direction in FIG. 1. The bottom end of the elevating board 58 supports rotatably the screw shaft 85. The inserting motor 79 rotates the screw shaft 85 about an axis of the screw shaft 85. The nut 86 is screwed on the screw shaft 85. A cylinder body 87 of the pull-testing cylinder 81 is attached to the nut 86. The inserting motor 79 moves the wire-chucks 84 toward or away from the connector housing 3 retained by the housing retainer 27 of the housing-holding unit 12.

The pull-testing cylinder 81 includes a cylinder body 87 and an extendable rod 88 extending from the cylinder body 87. The cylinder body 87 is mounted on the nut 86 in a manner that the rod 88 longitudinally extends in the horizontal direction and in the right-to-left direction in FIG. 1, and extension of the rod 88 moves the cylinder body 87 toward the housing-holding unit 12.

The chuck-supporting board 82 is attached to the rod 88 of the pull-testing cylinder 81. Extension or contraction of the rod 88 from the cylinder body 87 moves the chuck-supporting board 82 toward or away from the housing-holding unit 12.

The chucking cylinder 83 includes a cylinder body 89 attached to the chuck-supporting board 82, and a not-shown pair of contacting rods projecting from the cylinder body 89. The contacting rods project from the cylinder body 89 toward the housing-holding unit 12 and are arranged from front to back of FIG. 1 separately. The pair of contacting rods moves toward and away from each other. The wire-chucks 84 are respectively attached to the contacting rods. Therefore, the wire-chucks 84 move between positions shown by a solid line and an alternate long and two short dashes line in FIG. 6. The pair of wire-chucks 84 moves toward each other and catches the electric wire 5 connected to the terminal fitting 6 therebetween.

In the terminal-inserting unit 14, firstly the elevating cylinder 57 moves the elevating board 58 down and the rod 76 of the elevating cylinder 71 extends. Then, by the pair of contacting rods 78 of the chucking cylinder 73 moving toward and away from each other, the pair of front chucks 74 catches the electric wire 5 held in the wire holder 20 (at 3 mm behind the terminal fittings 6). In the terminal-inserting unit 14, by the pair of contacting rods of the chucking cylinder 83 moving toward and away from each other, the pair of wire-chucks 84 also catches the electric wire 5 held in the wire holder 20.

Then, the elevating cylinder 57 of the terminal-inserting unit 14 moves the elevating board 58 up to remove the terminal fitting 6 and the electric wire 5 connected to the terminal fitting 6 from the wire holder 20 of the wire-holding unit 11. Thus, the terminal-inserting unit 14 removes the electric wire 5 from the wire-holding unit 11.

In the terminal-inserting unit 14, the rod 70 of the inserting cylinder 59 extends to move the elevating board 58 toward the housing retainer 27. The terminal-inserting unit 14 inserts the terminal fitting 6 into the guiding opening 54 of the guiding unit 13. Then, the terminal-inserting unit 14 removes the pair of front chucks 74 from each other so that the elevating cylinder 71 of the front chucking unit 60 moves the pair of front chucks 74 up (away from the electric wire 5). The inserting motor 79 of the terminal-inserting unit 14 or the like moves the wire-chucking unit 61 toward the housing retainer 27 and inserts the terminal fitting 6 into the terminal-receiving hole 4 of the connector housing 3 retained by the housing retainer 27.

Then, the locking arm is locked to fix the connector housing 3 and the terminal fitting 6 together. Then, the pull-testing cylinder 81 of the terminal-inserting unit 14 pulls the electric wire 5. Then the terminal-inserting unit 14 removes the wire-chucks 84 from each other and removes the wire-chucking unit 61 from the electric wire 5. Then, the terminal-inserting unit 14 repeatedly removes the next electric wire 5 from the wire holder 20 and inserts the terminal fitting 6 connected to the electric wire 5 into the terminal-receiving hole 4.

After the last terminal fitting 6 is inserted into the terminal-receiving hole 4, the wire-chucking unit 61 of the terminal-inserting unit 14 holds the electric Wire 5 connected to the lastly inserted terminal fitting 6. Then, the elevating unit 24 of the housing-holding unit 12 moves the housing retainer 27 and the like down to remove the connector housing 3 from the housing retainer 27.

Then, while the wire-chucking unit 61 holds the electric wire 5 of the lastly inserted terminal fitting 6, the terminal-inserting unit 14 presses the electric wire 5 into between the clipping members 22*a*, 22*b* of the wire holder 20 with movements of the inserting cylinder 59, the inserting motor 79, the elevating cylinder 57, the horizontally moving unit 55 and the like. Thus, the terminal-inserting unit 14 moves the electric wire 5 connected to the lastly inserted terminal fitting 6 to the wire-holding unit 11 and makes the wire-holding unit 11 hold the electric wire 5.

The controller 15 is a well-known computer having RAM, ROM, CPU and the like. The controller 15 is connected to the housing-holding unit 12, the guiding unit 13, and the terminal-inserting unit 14, and controls them to control the whole terminal inserting apparatus 1.

The controller 15 stores an order of inserting the terminal fittings 6 into the terminal-receiving holes 4 of the connector housing 3 for each part number of the connector 2 to be assembled, positions of the terminal fittings 6 in the wire holder 20, locations of respective terminal-receiving holes 4, and the like. The controller 15 further stores a location of a pair of clipping members 22*a*, 22*b* between which the electric wire 5 connected to the lastly inserted terminal fitting 6 is pressed into. Peripheral input devices such as a keyboard or a switch are connected to the controller 15.

In the terminal inserting apparatus 1, when the terminal fitting 6 is inserted into the terminal-receiving hole 4 of the connector housing 3, firstly, a part number of the connector 2 to be assembled is inputted into the controller 15. Then the housing retainer 27 corresponding to the part number is set on the supporting table 25 of the housing-holding unit 12, and the wire holder 20 corresponding to the part number is set on the unit body 19 of the wire-holding unit 11.

Figure 8:
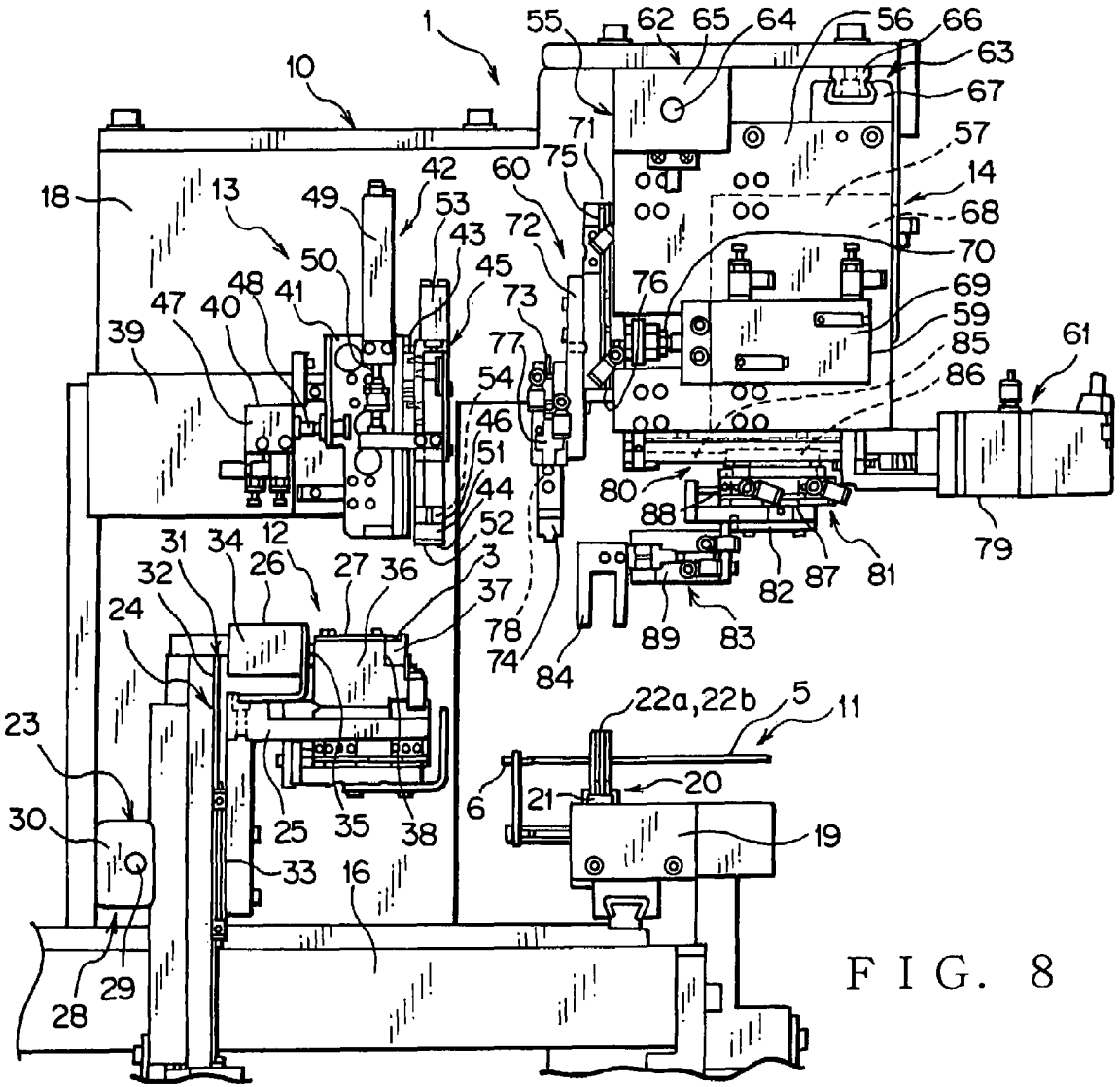
FIG. 8 is a side view showing a state that the housing retainer and the like are attached to a housing-holding unit, and the terminal fittings are about to be inserted into the connector.

Then, start signal is inputted from the input device. Then, as shown in FIG. 8, the elevating unit 24 of the housing-holding unit 12 moves the housing retainer 27 up, and the connector-fixing cylinder 26 holds the housing retainer 27 in the position of locking the connector housing. In this starting state, the rod 48 of the cross feed cylinder 40 extends, and the rod 50 of the guide switching part 45 in the elevating cylinder 42 contracts.

Further, the not-shown rod of the elevating cylinder 57 and the rod 70 of the inserting cylinder 59 contract. The rod 76 of the elevating cylinder 71 contracts and the pair of contacting rods 78 is removed from each other. The rod 88 of the pull-testing cylinder 81 extends, and the pair of not-shown contacting rods of the chucking cylinder 83 is removed from each other.

Then, the controller 15 controls the horizontally moving unit 23 to locate the terminal-receiving hole 4 for receiving the firstly inserted terminal fitting 6 under the guiding board 44, 46. Then, the controller 15 controls the horizontally moving unit 55 to locate the front chucking unit 60 over the terminal fitting 6 to be firstly inserted, and locate the wire-chucking unit 61 over the electric wire 5 connected to the terminal fitting 6.

As shown in FIG. 9, then, under the control of the controller 15, the rod 50 of the elevating cylinder 42 extends to overlap the fixed guiding board 44 with the opening of the terminal-receiving holes 4 of the connector housing 3 retained in the housing retainer 27. Further, under the control of the controller 15, the rod 76 of the elevating cylinder 71 extends, and the elevating cylinder 57 moves the front chucking unit 60 and the wire-chucking unit 61 toward the terminal fitting 6 and the electric wire 5 held by the wire-holding unit 11.

At this time, the terminal fitting 6 is interposed between the pair of front chucks 74, and the electric wire 5 is interposed between the pair of wire-chucks 84. Then, the controller 15 controls the chucking cylinders 73, 83 of the chucking units 60, 61 so that the electric wire 5 is chucked between the pair of front chucks 74 and between the wire-chucks 84.

Figure 10:
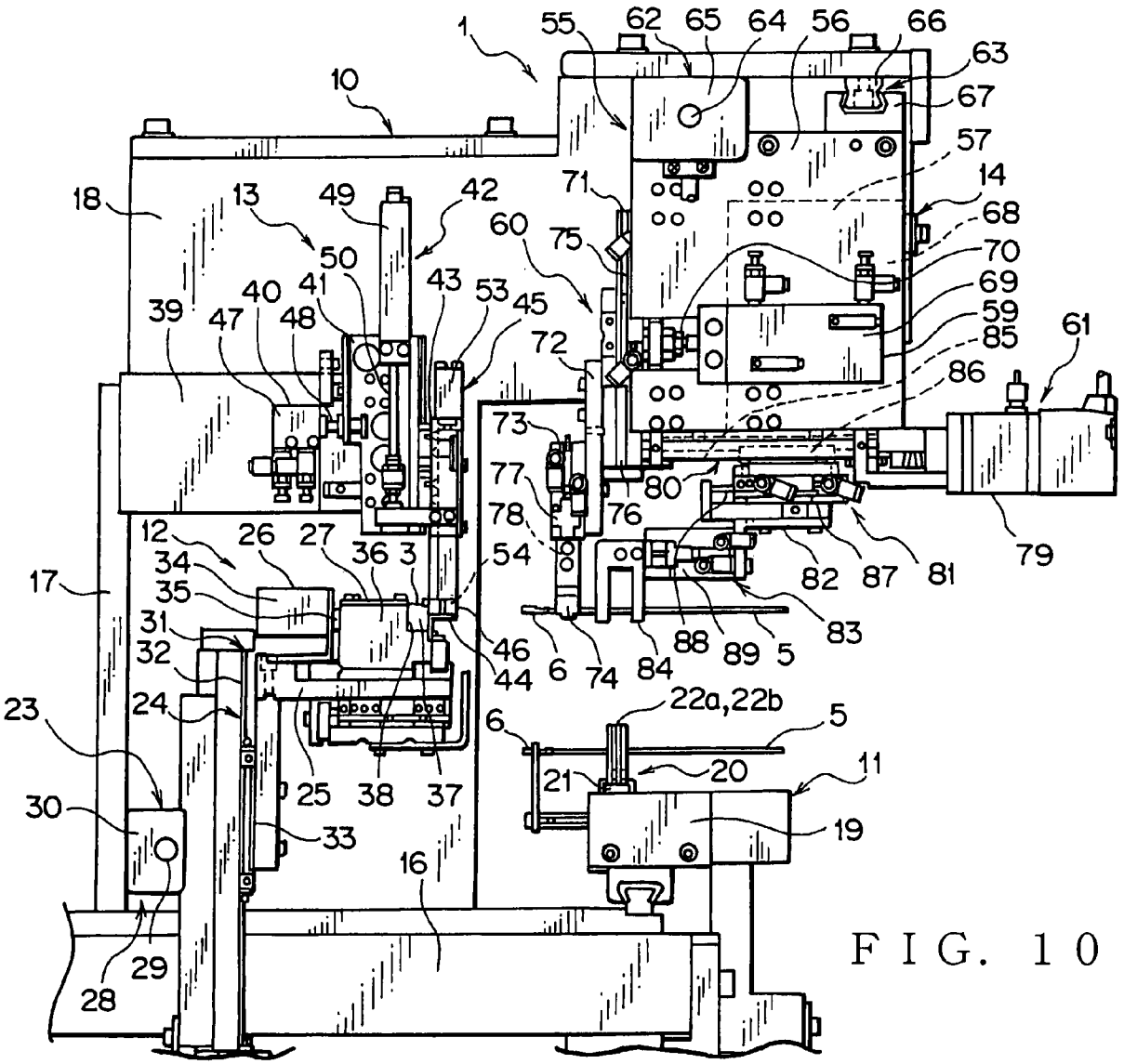
FIG. 10 is a side view showing a state that the fixed guiding board contacts the connector housing, and the chucking units elevate.

Next, as shown in FIG. 10, under the control of the controller 15, the rod 48 of the cross feed cylinder 40 contracts to press the fixed guiding board 44 on the connector housing 3 retained by the housing retainer 27. The guide switching part 45 controlled by the controller 15 makes the bottom end of the movable guiding board 46 contact the horizontal part 52 of the fixed guiding board 44.

Then, as shown in FIG. 10, under the control of the controller 15, the elevating cylinder 57 of the terminal-inserting unit 14 moves the chucking units 60, 61 up to remove the chucked electric wire 5 from the wire holder 20 of the wire-holding unit 11. Then, the terminal-receiving holes 4 of the connector housing 3 retained by the housing retainer 27 faces the terminal fitting 6 connected to the electric wire 5 chucked by the front chucking unit 60.

Figure 11:
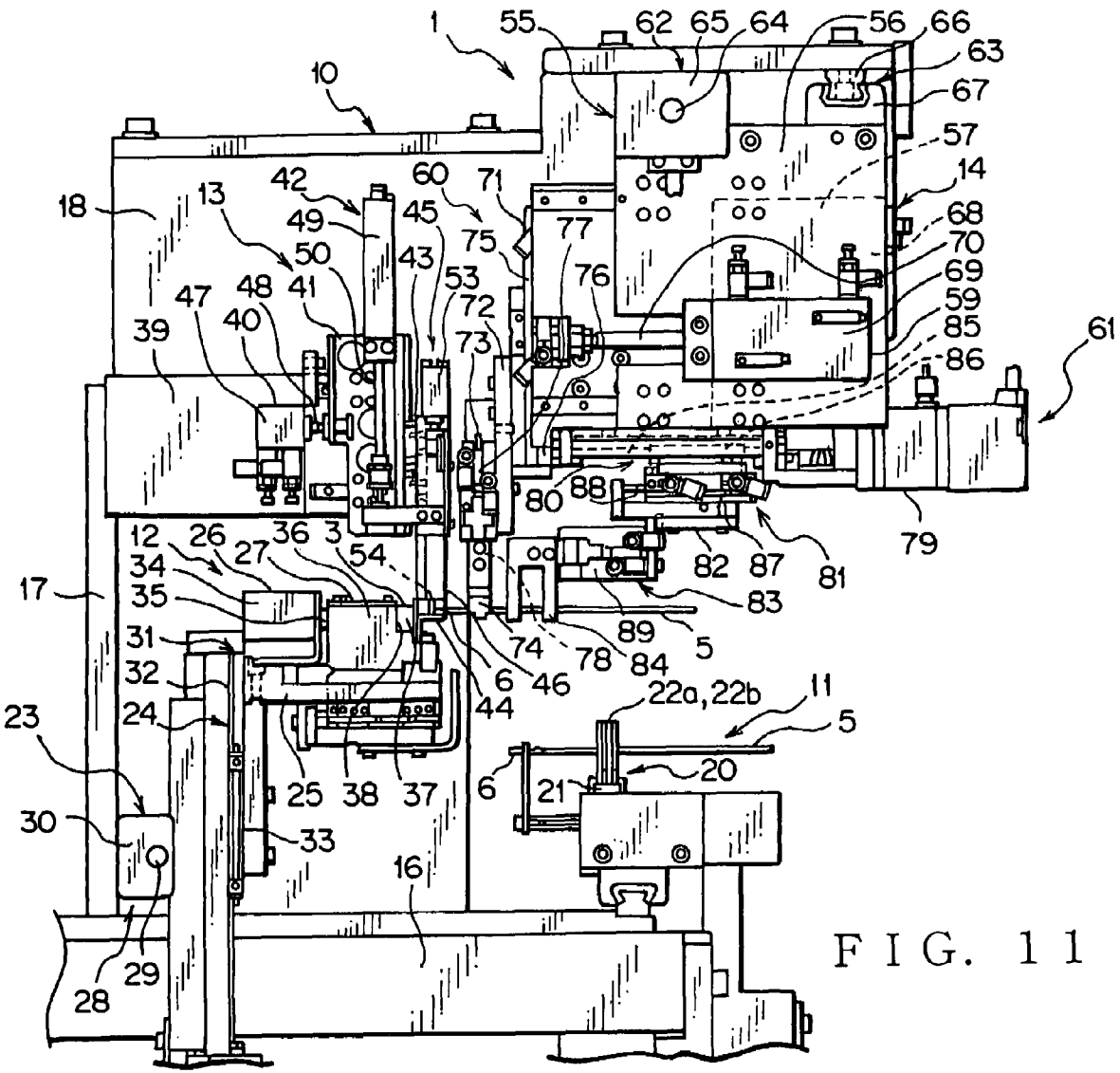
FIG. 11 is a side view showing a state that the terminal fitting is moved from a position shown in FIG. 10 and inserted into a guiding notch of the movable guiding board.
Figure 12:
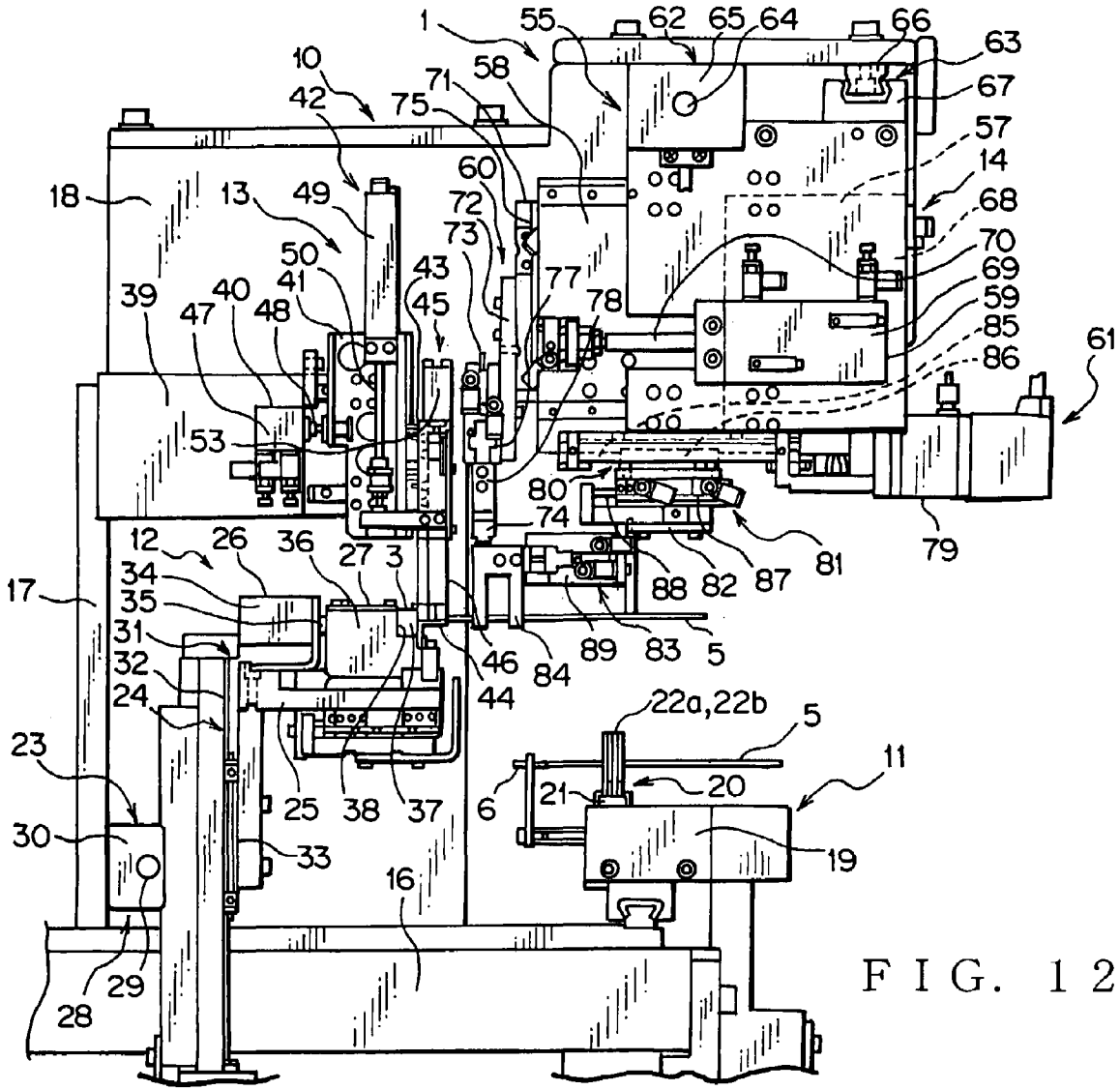
FIG. 12 is a side view showing a state that the terminal fitting is moved from a position shown in FIG. 11 and inserted into a receiving hole of the connector housing.

Then, as shown in FIG. 11, under the control of the controller 15, the rod 70 of the inserting cylinder 59 extends to insert the terminal fitting 6 into the guiding opening 54 of the movable guiding board 46. Then, as shown in FIG. 12, the controller 15 controls the chucking cylinder 73 of the front chucking unit 60 to remove the pair of front chucks 74 from the electric wire 5, and controls the elevating cylinder 71 of the front chucking unit 60 to move the pair of front chucks 74 and the like up (away from the terminal fitting 6). The controller 15 also controls the inserting motor 79 of the terminal-inserting unit 14 to insert the terminal fitting 6 into the terminal-receiving hole 4 of the connector housing 3 retained by the housing retainer 27.

Figure 13:
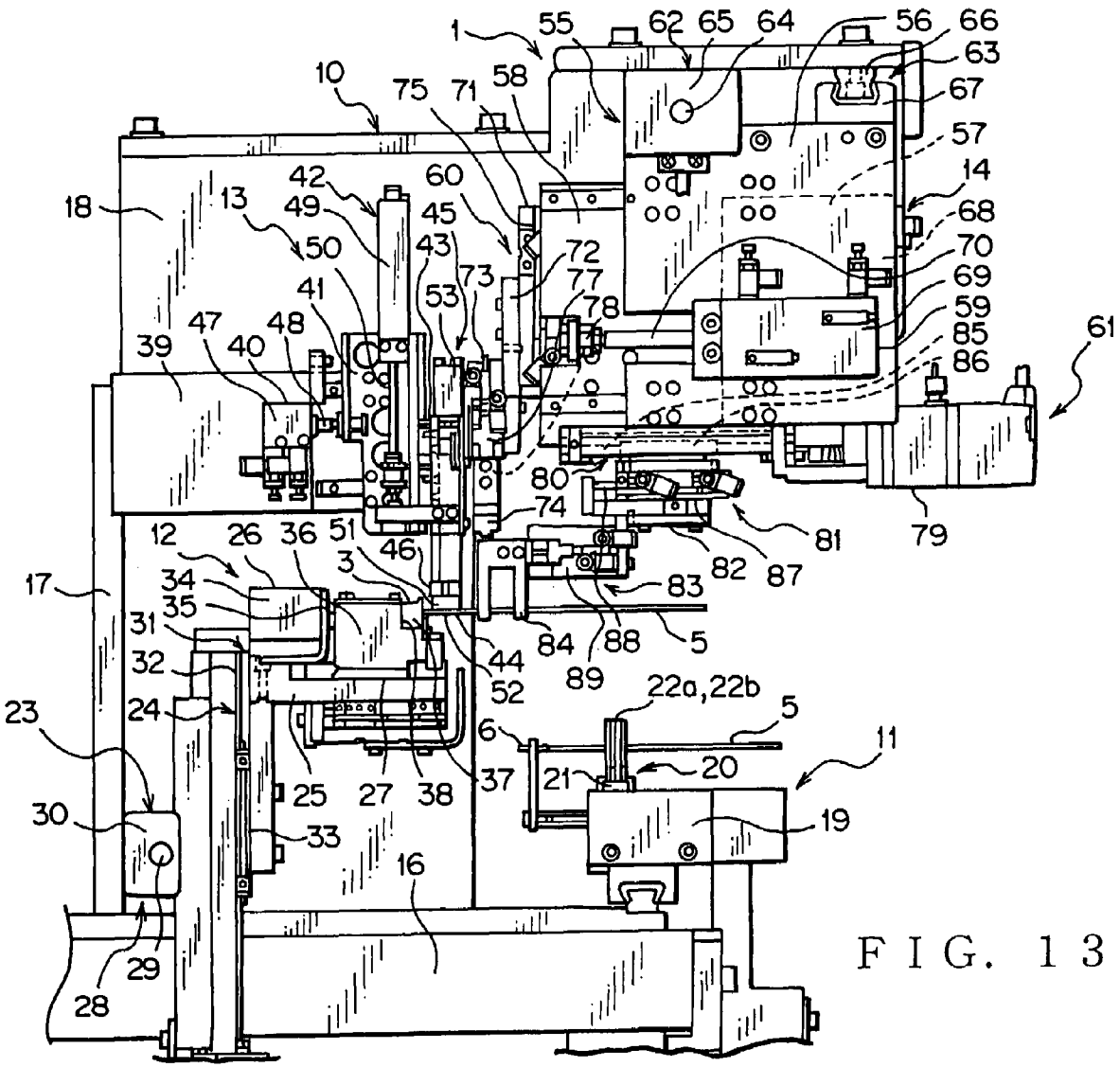
FIG. 13 is a side view showing a state that the movable guiding board is elevated from a position shown in FIG. 12 to remove the fixed guiding board from the connector housing.

Then, as shown in FIG. 13, under the control of the controller 15, the guide switching part 45 of the guiding unit 13 moves the movable guiding board 46 up, and the rod 48 of the cross feed cylinder 40 extends to remove the fixed guiding board 44 from the connector housing 3. Then, by the control of the controller 15, while the wire-chucks 84 chuck the electric wire 5, the horizontally moving unit 23 of the housing-holding unit 12 and the horizontally moving unit 55 of the terminal-inserting unit 14 respectively move the chucking units 60, 61 of the terminal-inserting unit 14 and the housing retainer 27 of the housing-holding unit 12 simultaneously toward, for example, the front side of FIG. 13.

Resultingly, the electric wire 5 is removed from between the horizontal part 52 of the fixed guiding board 44 and the movable guiding board 46. Then, the controller 15 controls the wire-chucking unit 61 to remove the wire-chucks 84 from the electric wire 5. By repeating the process shown in FIG. 8 to FIG. 13, the controller 15 sequentially inserts the terminal fittings 6 into the terminal-receiving holes 4 of the connector housing 3.

Figure 14:
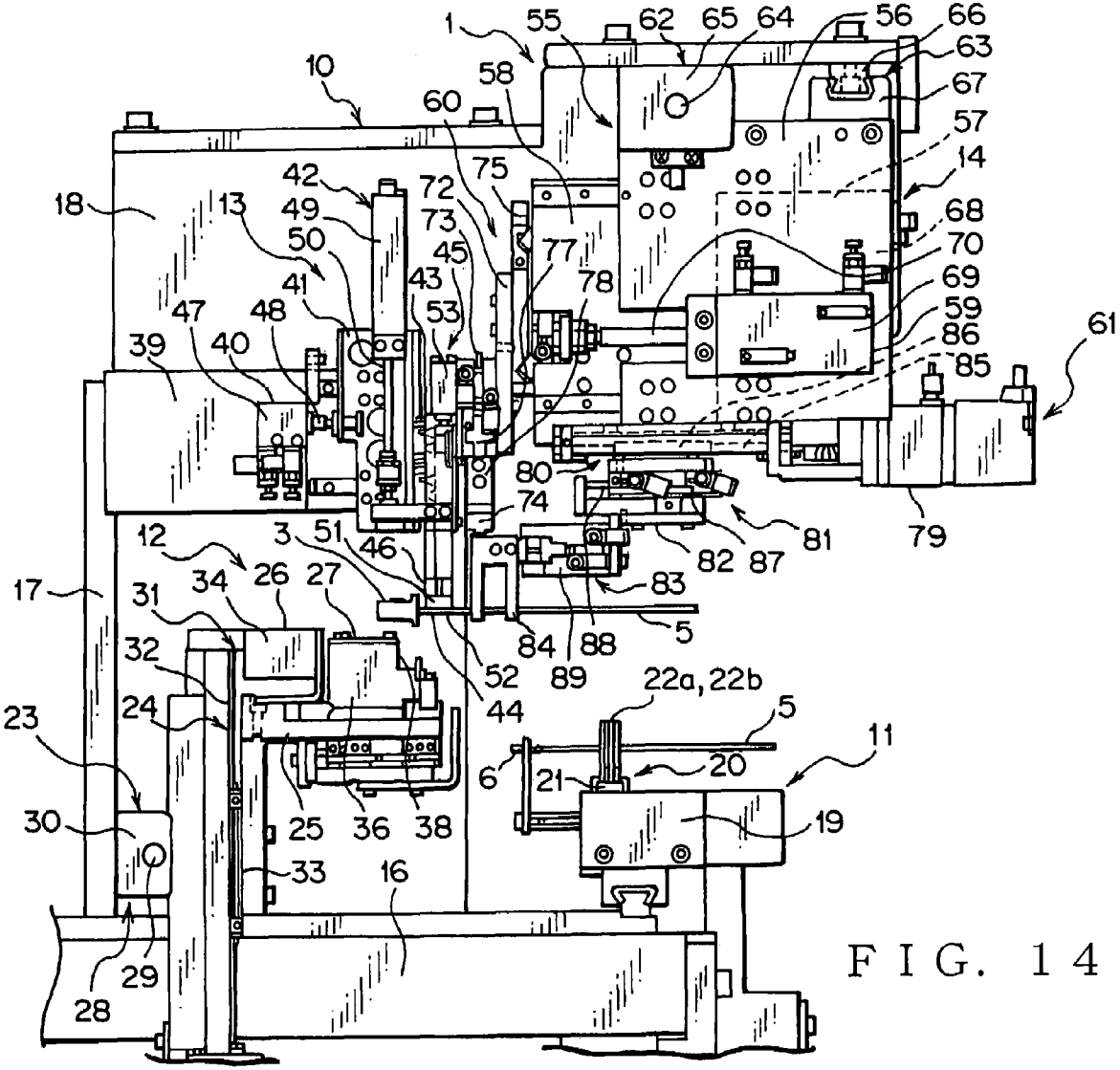
FIG. 14 is a side view showing a state that the housing retainer is moved down from a position shown in FIG. 13.

After the last terminal fitting 6 is inserted, under the control of the controller 15, the rod 35 of the connector-fixing cylinder 26 contracts to make the housing retainer 27 in the position of unlocking the connector housing. Then, as shown in FIG. 14, while the wire-chucking unit 61 chucks the electric wire 5 connected to the lastly inserted terminal fitting 6, the elevating unit 24 of the housing-holding unit 12 controlled by the controller 15 moves the housing retainer 27 down.

Figure 15:
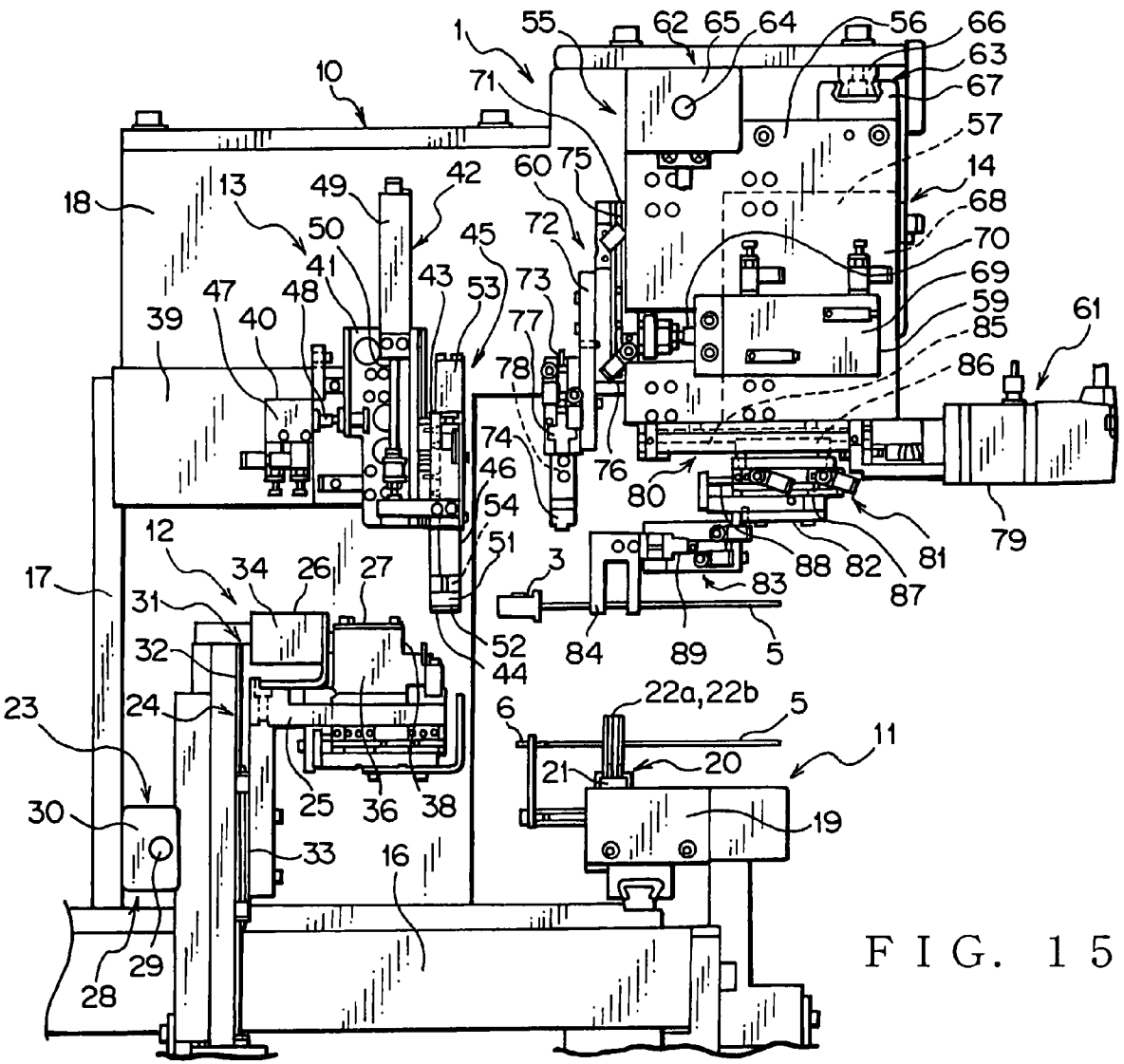
FIG. 15 is a side view showing a state that the electric wire is located over the wire holder from a position shown in FIG. 14.
Figure 16:
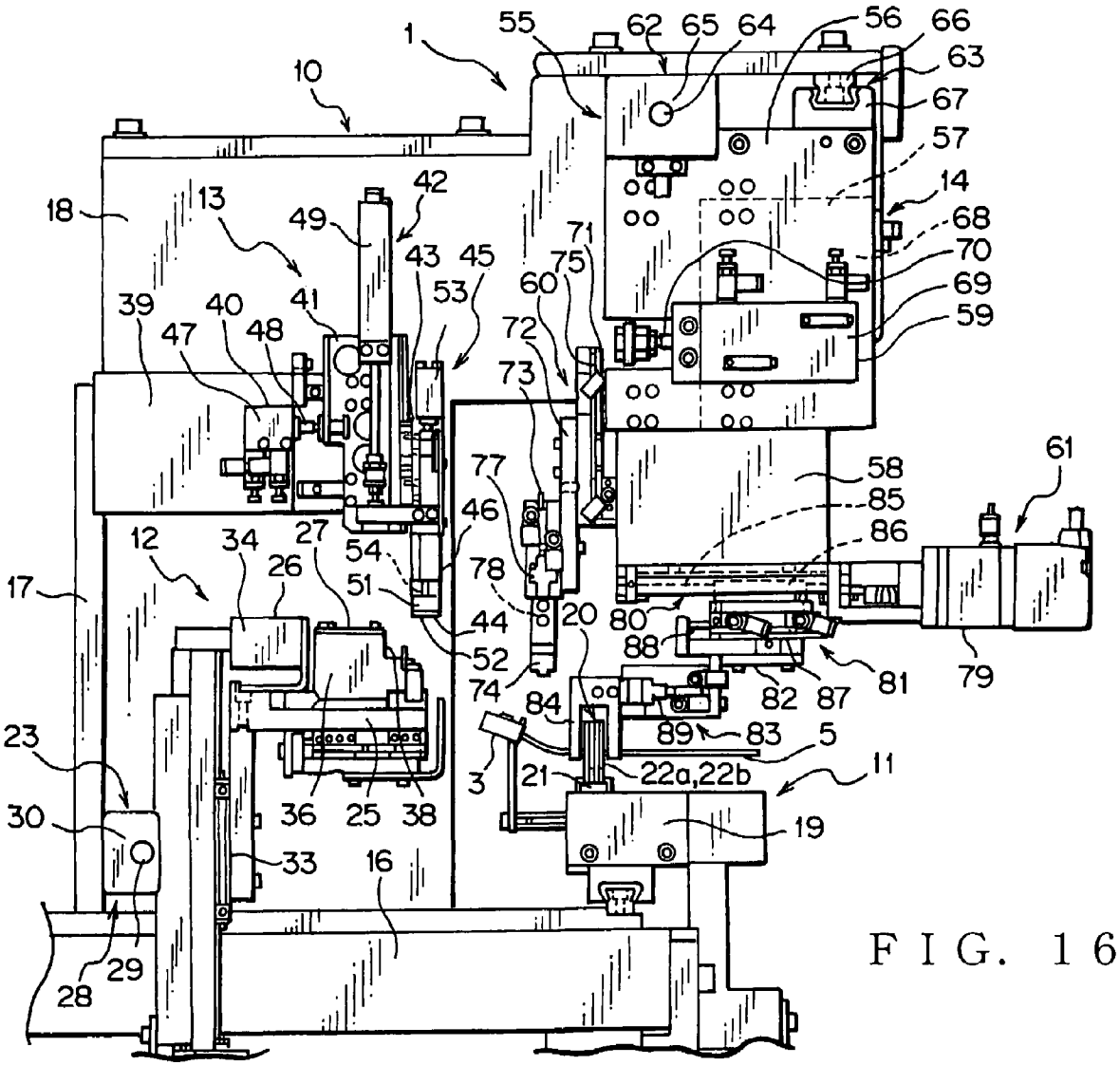
FIG. 16 is a side view showing a state that the electric wire connected to the connector housing is moved from a position shown in FIG. 15 to be held in the wire holder.

Then, since the electric wire 5 is chucked by the wire-chucks 84, the connector housing 3 is removed from the housing retainer 27. Then, as shown in FIG. 15, the horizontally moving unit 55 controlled by the controller 15 moves the wire-chucks 84 or the like over the clipping members 22*a*, 22*b* for clipping the electric wire 5 attached to the connector housing 3. Then, as shown in FIG. 16, the elevating cylinder 57 of the terminal-inserting unit 14 or the like, controlled by the controller 15 moves the wire-chucks 84 or the like down to press the electric wire 5 attached to the housing 3, and chucked by the wire-chucks 84 into between the clipping members 22*a*, 22*b*. Thus, the wire-holding unit 11 holds the electric wire 5 attached to the connector housing 3.

According to this embodiment of the present invention, after the terminal-inserting unit 14 inserts the last terminal fitting 6, while the terminal-inserting unit 14 chucks the electric wire 5 connected to the last inserted terminal fitting 6, the wire-holding unit 11 holds the electric wire 5. Therefore, an operator is not needed for holding the electric wire 5 by hand. Therefore, reduction of working efficiency is prevented. Further, the connector housing 3 having the terminal fittings 6 is correctly positioned in the wire holder 20 of the wire-holding unit 11.

Since the terminal-inserting unit 14 moves the housing retainer 27 down after the last terminal fitting 6 is inserted, the connector housing 3 is reliably removed from the housing retainer 27. Therefore, the wire-holding unit 11 reliably holds the connector housing 3.

Since the connector-fixing cylinder 26 switches the housing retainer 27 into the position unlocking after the last terminal fitting 6 is inserted, the connector housing 3 is reliably removed from the housing retainer 27. Therefore, the wire-holding unit 11 reliably holds the connector housing 3.

Further, since the connector-fixing cylinder 26 switches the housing retainer 27 into the position of locking the connector housing before the terminal-inserting unit 14 inserts the terminal fitting 6, the connector housing 3 is prevented from suddenly falling out of the housing retainer 27. Therefore, the terminal fittings 6 are reliably inserted into the terminal-receiving holes 4 of the connector housing 3. Further, in this embodiment, the terminal fittings 6 may not be inserted into all of the terminal-receiving holes 4. In short, according to the present invention, after the terminal fittings 6 are inserted into the terminal-receiving holes 4 to be inserted to, while the electric wire 5 connected to the lastly inserted terminal fitting 6 is chucked, the electric wire 5 is moved to the wire-holding unit 11 and held by the wire-holding unit 11.

Having now fully described the present invention, it will be apparent to one of ordinary skill in the art that many switches and modifications can be made thereto without departing from the scope of the invention as set forth herein.

What is claimed is:

1. A terminal inserting apparatus for inserting terminal fittings connected to electric wires into terminal-receiving holes of a connector housing, said terminal inserting apparatus comprising:

an electric wire holder for holding electric wires connected to the terminal fittings;

a terminal-inserting unit for removing the electric wires from the electric wire holders and inserting the terminal fittings connected to the electric wires into the terminal-receiving holes of the connector housing, a housing retainer for retaining the connector housing;

an elevating unit for vertically supporting the housing retainer, and a controller connected to the terminal-inserting unit and the elevating unit;

wherein after all the terminal fittings to be inserted are inserted into the terminal-receiving holes, the controller directs the terminal-inserting unit to hold the electric wire of the lastly inserted terminal fitting, move the electric wires with the connector housing to the electric wire holder, and make the electric wire holder hold the electric wires, and wherein while said terminal insertion unit holds the electric wire connected to the lastly inserted terminal fitting of the connector housing retained by the housing retainer, said elevating unit, at the direction of the controller, moves the housing retainer down, relative to the terminal-inserting unit, so as to remove the connector housing from the housing retainer.

2. The terminal inserting apparatus as claimed in claim 1, further comprising a connector fixing unit for switching the housing retainer between two positions of locking and unlocking the connector housing, said connector fixing unit being supported vertically with the housing retainer by the elevating unit, wherein said connector fixing unit holds the housing retainer in the position of locking the connector housing when the terminal-inserting unit inserts the terminal fittings into the terminal-receiving holes, and switches the housing retainer into the position of unlocking the connector housing after the terminal fittings are inserted into the receiving holes.

* * * * *